US010563944B2

(12) United States Patent
Campbell et al.

(10) Patent No.: US 10,563,944 B2
(45) Date of Patent: Feb. 18, 2020

(54) GUN BARREL SOUND SUPPRESSOR

(71) Applicants: Kevin C. Campbell, Maize, KS (US); Jeff A. White, Maize, KS (US)

(72) Inventors: Kevin C. Campbell, Maize, KS (US); Jeff A. White, Maize, KS (US)

( * ) Notice: Subject to any disclaimer, the term of this patent is extended or adjusted under 35 U.S.C. 154(b) by 0 days.

(21) Appl. No.: 16/169,451

(22) Filed: Oct. 24, 2018

(65) Prior Publication Data

US 2019/0145727 A1 May 16, 2019

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/34; F41A 21/325; F41A 21/36; F41A 21/28; F41A 21/26
USPC ..... 89/14.4; 181/223
See application file for complete search history.

(56) References Cited

U.S. PATENT DOCUMENTS 981,584 A * 1/1911 Miller ..... F01N 1/06 181/253
1,017,003 A * 2/1912 Kenney ..... F41A 21/30 181/223
1,021,742 A 3/1912 Moore
1,081,348 A * 12/1913 Unke ..... F01N 1/08 181/264
1,174,165 A * 3/1916 Kenney ..... F41A 21/36 89/14.3
1,450,558 A * 4/1923 Francois ..... F41A 1/00 89/1.1
2,514,996 A 7/1950 Faust, Jr.
3,399,597 A 9/1968 Perrine
4,291,610 A 9/1981 Waiser
4,576,083 A 3/1986 Seberger, Jr.
5,029,512 A 7/1991 Latka
6,425,310 B1 * 7/2002 Champion ..... F41A 21/30 89/14.3
7,073,426 B1 7/2006 White
7,207,258 B1 4/2007 Scanlon
7,237,467 B1 7/2007 Melton
7,308,967 B1 12/2007 Hoel
7,412,917 B2 8/2008 Vais
8,100,224 B1 1/2012 Olson
(Continued)

FOREIGN PATENT DOCUMENTS

EP 2325594 5/2011
WO WO2016126227 8/2016

*Primary Examiner* — Joshua E Freeman
(74) *Attorney, Agent, or Firm* — Kenneth H. Jack; Davis & Jack, L.L.C.

(57) ABSTRACT

A gun barrel sound suppressor incorporating a housing having a breach end, a muzzle end, and a barrel axis extending between those ends; a bullet passage conduit aligned with the barrel axis; a first annular gas outlet port opening the bullet passage conduit; a first annular gas inlet port further opening the bullet passage conduit, the first annular gas inlet port being positioned muzzlewardly from the first annular gas outlet port; a first circumferentially extending "U" channel having a web, having a breachward arm having a distal end, and having a muzzleward arm having a distal end, wherein the distal end of the first breachward arm communicates with the first annular gas outlet port, and wherein the distal end of the first muzzleward arm communicates with the first annular gas inlet port.

15 Claims, 4 Drawing Sheets

(56) References Cited

U.S. PATENT DOCUMENTS

| | | | | |
|---|---|---|---|---|
| 8,505,431 | B2 | 8/2013 | Hines | |
| 8,579,075 | B2 | 11/2013 | Brittingham et al. | |
| 8,910,746 | B1 | 12/2014 | McKenzie | |
| 8,967,326 | B2 | 3/2015 | Schlosser | |
| 8,978,818 | B2 | 3/2015 | Proske | |
| 9,086,248 | B2 | 7/2015 | Young et al. | |
| 9,115,949 | B1 | 8/2015 | Morrison | |
| 9,182,188 | B2 | 11/2015 | Gawencki | |
| 9,194,640 | B2 | 11/2015 | Wirth et al. | |
| 9,207,033 | B2 | 12/2015 | Vais | |
| 9,417,021 | B2 | 8/2016 | Pietila | |
| 9,593,899 | B2 | 3/2017 | Coppinger et al. | |
| 2015/0337878 | A1* | 11/2015 | Schlosser | F42B 10/42 181/213 |
| 2016/0054086 | A1 | 2/2016 | Westlake | |
| 2016/0123689 | A1* | 5/2016 | Maeda | F41A 21/30 89/14.3 |

* cited by examiner

GUN BARREL SOUND SUPPRESSOR

FIELD OF THE INVENTION

This invention relates to apparatus which are adapted for suppressing or moderating firearm muzzle blasts. More particularly, this invention relates to such apparatus which are formed as an integral part of a firearm's barrel or constitutes an attachable and detachable auxiliary component of a firearm's barrel.

BACKGROUND OF THE INVENTION

As a fired bullet traverse the barrel of a conventional rifle having no muzzle modifications, two distinct volumes of pressurized gas typically travel toward the muzzle (or muzzlewardly) along with the bullet. Such traveling bullet typically functions as a plunger or piston creating a pressure wave or zone of high pressure which moves muzzlewardly immediately in front of the bullet. Such moving zone of high pressure gas is referred to herein as a "muzzleward pressure wave".

Immediately to the rear of or breachwardly from such rifle fired bullet, a propellant induced pressure wave (i.e., a breachward pressure wave) similarly expands muzzlewardly along with the bullet, the front of such pressure wave residing immediately to the rear of the bullet. During such conventional firing of a bullet from a firearm having an unmodified or plain muzzle, the breachward pressure wave is typically of much greater magnitude and intensity than the above described muzzleward pressure wave. During such conventional bullet passage through an unmodified gun barrel, virtually all of the accumulated kinetic energy of the muzzleward pressure wave is harmlessly directed muzzlewardly and away from the traveling bullet. Accordingly, a plain or unmodified gun barrel muzzle advantageously tends to minimize any velocity reducing effects or bullet travel path perturbing effects of the muzzleward compression wave upon the bullet.

As a fired bullet approaches the muzzle, the muzzleward pressure wave within the rifle's bore typically emits and dissipates harmlessly and with little sound. In contrast, when the bullet clears the muzzle, the breachward pressure wave emits explosively from the muzzle and produces a loud report or muzzle blast along with a muzzle flash which is prominent during darkness. Conventional sound suppressors or modifiers which are attached to or integrally formed with a rifle's muzzle are known to be provided for reducing such muzzle blasts and muzzle flashes.

Commonly known muzzle mounted sound suppressors interpose a series of variously shaped chambers and sound baffles which are intended to minimize the magnitude or intensity of the breachward compression wave at its point of release from the rifle's muzzle. While such baffles and chambers effectively minimize or reduce muzzle blast and flash, they typically interfere with the ability of a plain muzzle gun barrel to harmlessly direct and emit the muzzleward compression wave. In operation of such common sound suppressors, portions of the muzzleward compression wave which are reflected radially inwardly toward the path of the bullet undesirably impinge against the bullet prior to the bullet's emergence from the muzzle. In contrast with an unmodified gun barrel muzzle which cleanly and efficiently emits the muzzleward compression wave ahead of and away from the traveling bullet, common sound suppression modified muzzles redirect portions of the muzzleward compression wave, and via such redirection threaten to perturb the travel path of the bullet and/or reduce the bullet's velocity.

The instant inventive gun barrel sound suppressor solves or ameliorates the problems, defects, and disadvantages described above by disposing and configuring at the muzzleward end of a gun barrel a series of circumferentially extending "U" channels having breachwardly canted "U" arms.

BRIEF SUMMARY OF THE INVENTION

A first structural component of the instant inventive gun barrel sound suppressor comprises a housing having a breach end, a muzzle end, and having a barrel axis extending between said ends. In a preferred embodiment, the housing comprises a cylindrical body of steel which is formed wholly or integrally with the muzzle end of a rifle barrel. Suitably, the breachward end of the instant invention's housing component may present a helically threaded fitting for secure and removable attachment of the housing at the muzzle end of a gun barrel.

A further structural component of the instant inventive sound suppressor comprises a bullet passage conduit which aligns with the barrel axis, and which fully extends between and opens at the housing's breachward muzzleward ends.

In a preferred embodiment, the bullet passage conduit is cylindrically walled and has a diameter at least one millimeter greater than that of the bore of the gun barrel from which the housing extends. Such excess diameter dimension prevents contacts and impingements of a fired bullet against the walls of the bullet passage conduit.

A further structural component of the instant inventive sound suppressor comprises at least a first ring shaped or annular gas outlet port which further opens the bullet passage conduit. Such outlet port emits compressed gas radially outwardly from the bullet passage conduit.

A further structural component of the instant inventive sound suppressor comprises a corresponding gas inlet port which, similarly with the gas outlet port, is annularly configured. Such gas inlet port further opens the bullet passage conduit at a point immediately muzzlewardly from the annular gas outlet port and reintroduces the compressed gas into the bullet passage conduit at that point.

A further structural component of the instant inventive sound suppressor comprises at least a first circumferentially or annularly extending "U" channel whose paired "U" arms have distal ends connecting with or respectively communicating with the annular gas outlet and inlet ports. Compressed gas entering the "U" channel via the annular gas outlet port traverses such channel to re-enter the bullet conduit at the muzzlewardly adjacent gas inlet port.

In the preferred embodiment, the at least first circumferentially extending "U" channel has a cone shaped and breachwardly canted breachward arm, and a cone shaped and breachwardly canted muzzleward arm. Such "U" channel further has a web portion which spans between and communicates gas passage between proximal ends of such breachward and muzzleward arms.

Further and additional annular gas outlet and annular gas inlet ports are preferably positioned breachwardly and muzzlewardly along the path of the bullet and within the housing, such further ports being similarly joined for compressed gas communication by further and additional circumferentially extending "U" channels.

In operation of the instant inventive gun barrel sound suppressor, the preferred breachward cants or tilts of the breachward arms of the circumferentially extending "U"

channels dually function for efficient collection of compressed gases from the annular gas outlet ports and for increasing the length of the gas transit paths along such arms within the housing. The preferred breachward cants of the muzzleward arms of the circumferential "U" channels similarly dually function for increasing the gas transit path within the housing, while assuring that each annular gas inlet port is relatively closely spaced muzzlewardly from its breachwardly adjacent gas outlet port. Accordingly, the shared canted characteristic of the breachward and muzzleward arms of the invention's circumferentially extending "U" channels advantageously allows the nose of a bullet traversing the bullet passage conduit to pass muzzlewardly beyond an annular gas inlet port prior to re-injection of gas from such port into the bullet passage conduit.

While the instant inventive gun barrel sound suppressor does interfere with and alter muzzleward direction of the kinetic energy of the bullet's muzzleward pressure wave, the invention's provision of "U" channels having canted arms assures that such redirected pressure wave energy harmlessly passes to the rear of or breachwardly from such bullet.

Accordingly, the objects of the instant invention include the provision of a gun barrel sound suppressor which incorporates structures as described above, and which arranges those structures in relation to each other in manners described above, or the achievement of the functional benefits described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
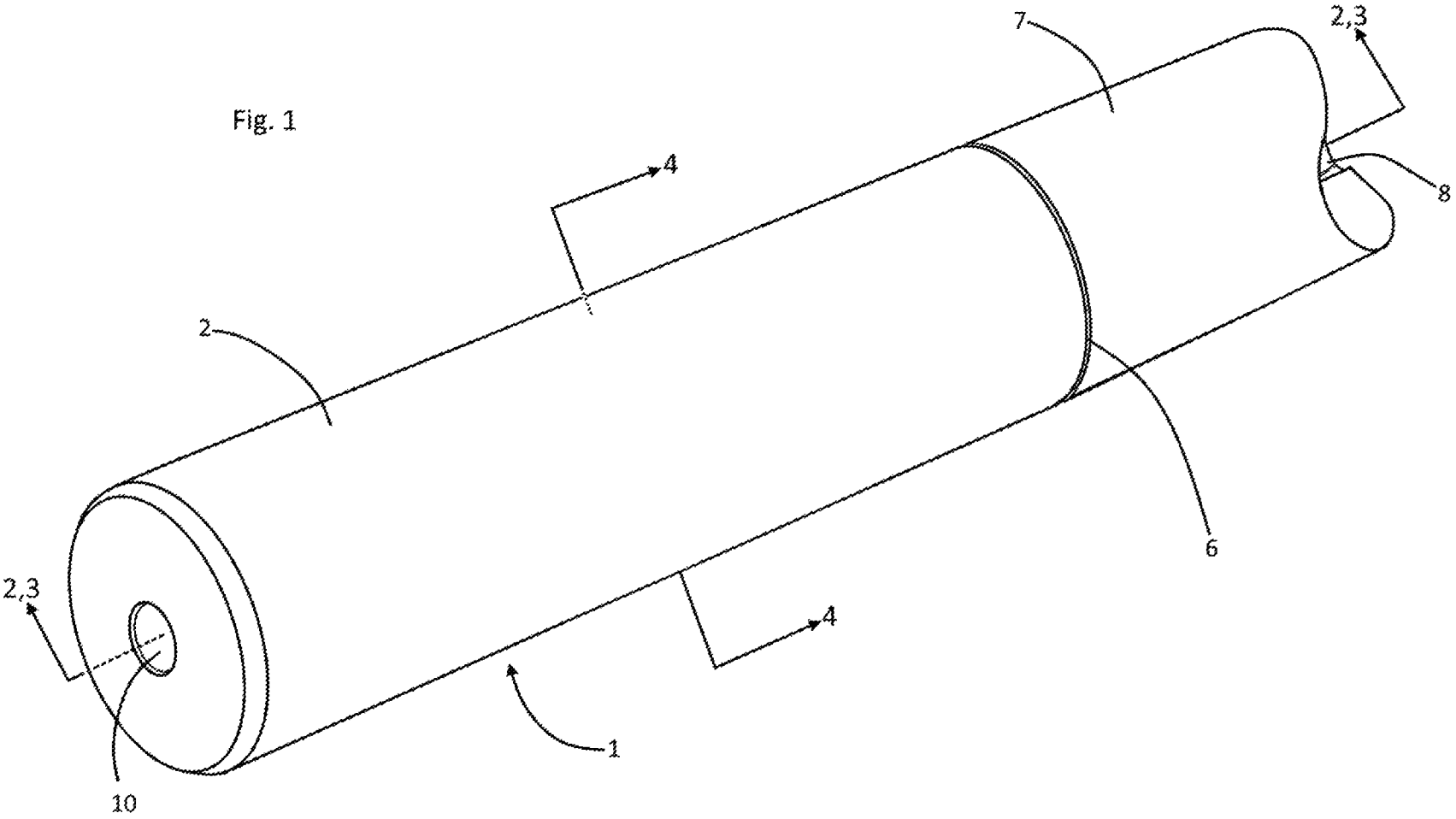
FIG. 1 is a perspective view of a preferred embodiment of the instant inventive gun barrel sound suppressor.
Figure 2:
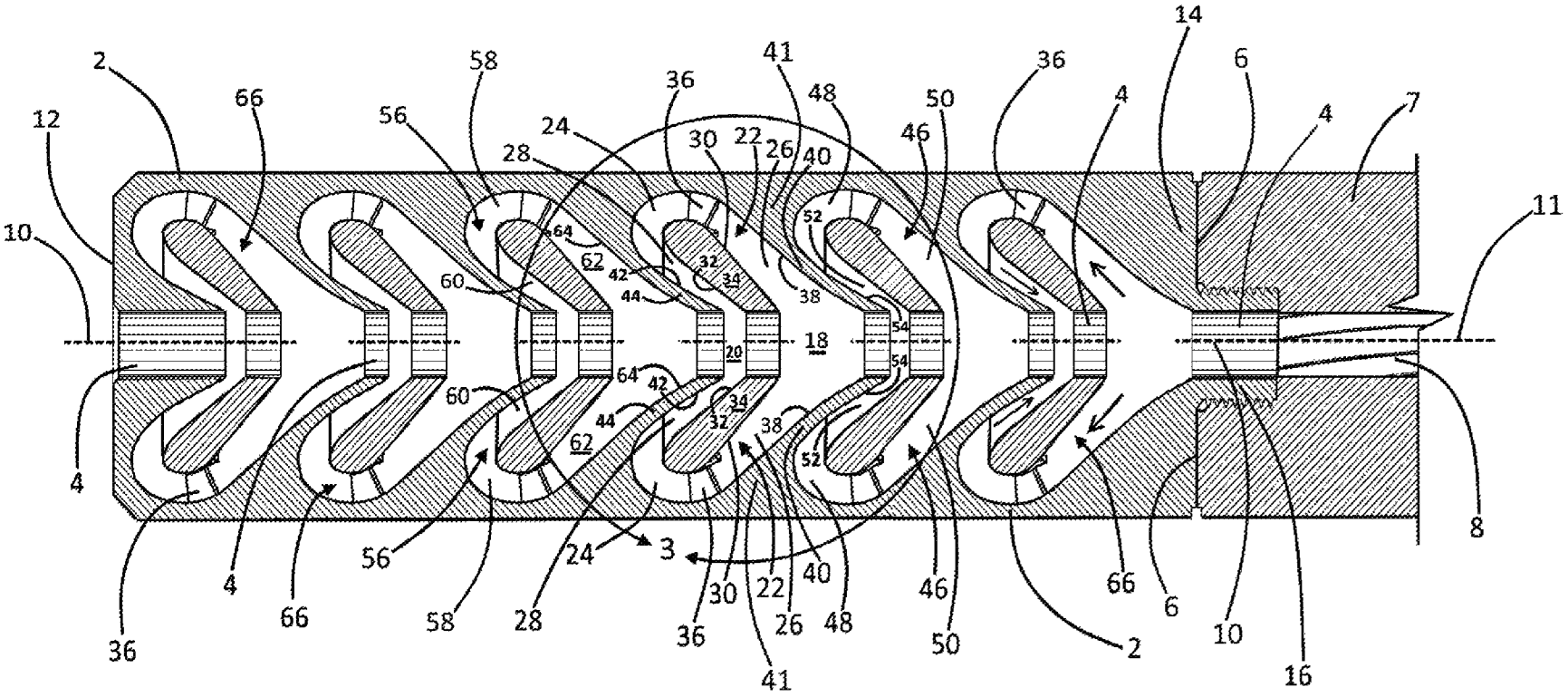
FIG. 2 is a longitudinal cross sectional view of the sound suppressor of FIG. 1, as indicated in FIG. 1.

Referring now to the drawings and in particular to Drawing FIG. 1, a preferred embodiment of the instant inventive gun barrel sound suppressor is referred to generally by Reference Arrow 1. The sound suppressor 1 has a cylindrical housing 2. Referring further simultaneously to FIG. 2, the housing 2 has a muzzleward end 12, and has a breachward end 14. Such breachward housing end 14 may suitably be configured to present a helically threaded fitting 16 for removable mounting at a seam 6 at the muzzle end of a rifle barrel 7, such rifle barrel 7 having a rifled bore 8. The housing 2 has a central and longitudinally extending barrel axis 10, such axis preferably being aligned with and co-extensive with the barrel axis 11 of the rifle bore 8.

The instant inventive sound suppressor 1 further has a longitudinally extending bullet passage conduit 4 which forms a muzzleward extension of the rifle bore 8. In a preferred embodiment, the inside diameter of the conduit 4 is slightly greater than that of the rifled bore 8 so that muzzlewardly passing bullets will not impinge against wall surfaces which surround and define conduit 4.

Figure 3:
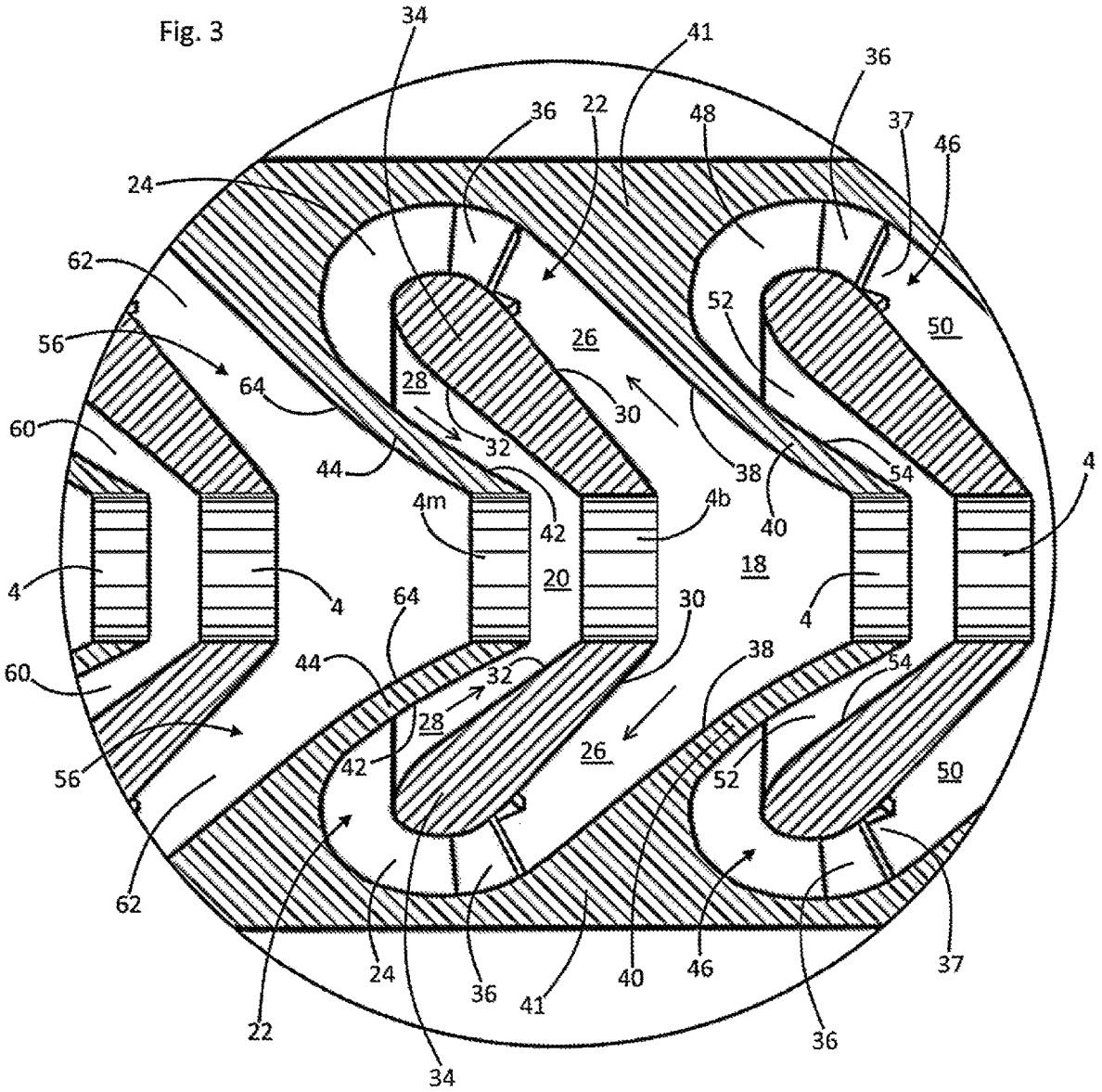
FIG. 3 is a magnified view of a portion of the structure of FIG. 2, as indicated in FIG. 2.

Referring to FIGS. 2 and 3, the instant inventive sound suppressor preferably comprises at least a first annular gas outlet port 18, such port 18 preferably opening the bullet passage conduit 4 continuously circumferentially and in all radially outward directions. A similarly configured but preferably longitudinally shorter annular gas inlet port 20 is preferably provided, such port further opening the bullet passage conduit 4 at a point immediately muzzlewardly from the at least first annular gas inlet port 18.

The instant inventive gun barrel sound suppressor 1 preferably further comprises at least a first circumferentially or annularly extending "U" channel, such channel being referred to generally by Reference Arrow 22. Such at least first "U" channel 22 has a breachward arm 26, a muzzleward arm 28, and has a web 24 which spans between and interconnects the proximal ends of such breachward and muzzleward arms. For enhancement of gas flows between such arm proximal ends, the web 24 is preferably arcuately curved. For purposes and functions further discussed below, it is preferred that the breachward and muzzleward arms 26 and 28 of the at least first circumferentially extending "U" channel 22 be canted or sloped breachwardly from their proximal end at web 24 to their respective distal end openings at the outlet and inlet ports 18 and 20.

In the formation of the breachward and muzzleward arms 26 and 28 of the first "U" channel 22, a first breachward conical wall 30 and a first muzzleward conical wall 32 are provided, such walls 30 and 32 comprising breachward and muzzleward faces (or outer and inner faces) of an at least first cone element 34.

Figure 4:
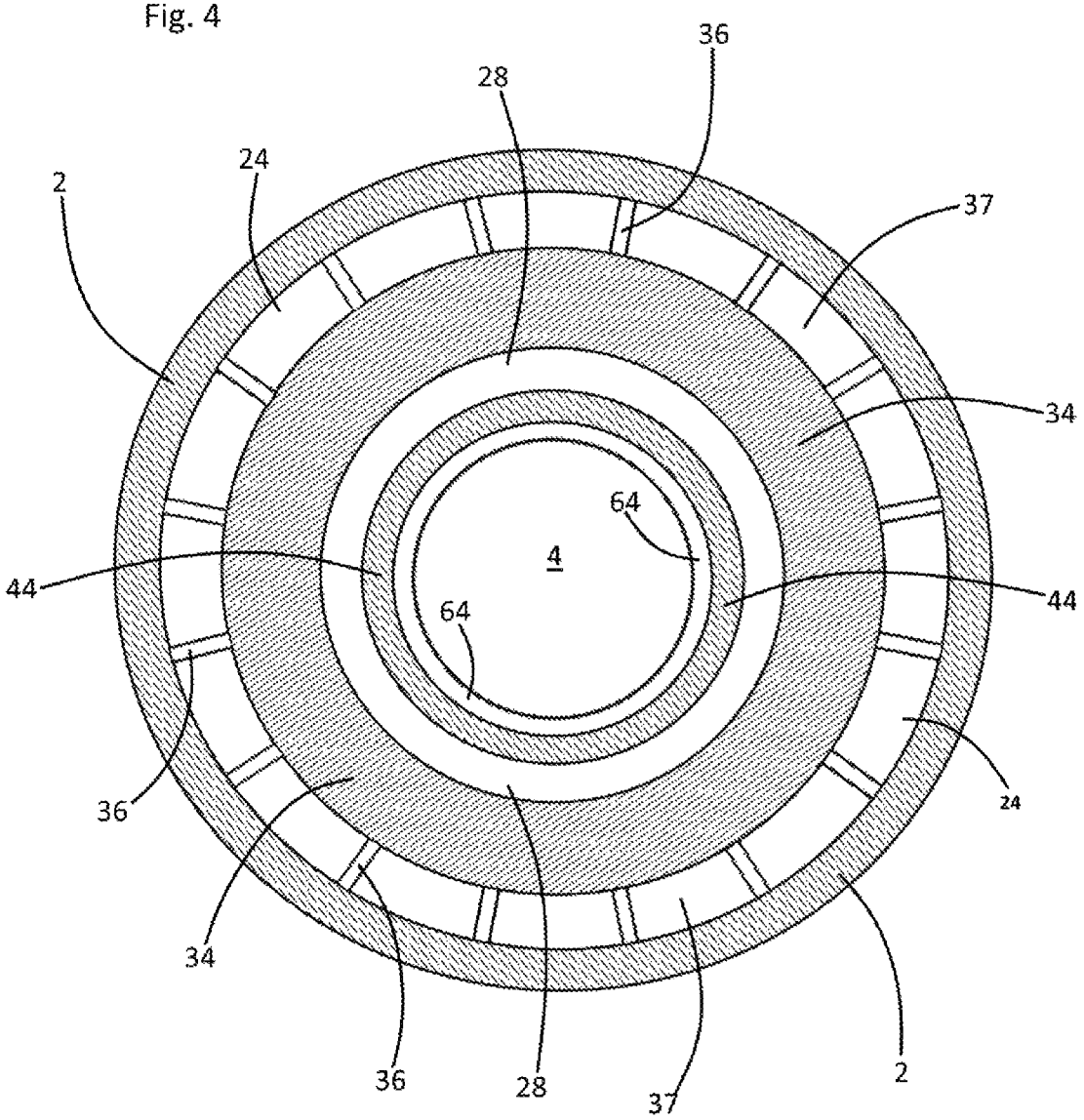
FIG. 4 is a lateral cross sectional view of the structure of FIG. 1, as indicated in FIG. 1.

In a preferred embodiment, the vertex of the at least first cone 34 is positioned at channel 4 in alignment with barrel axis 10. In order to rigidly position the at least first cone 34 between the two arms 26 and 28 of the "U" channel 22, a circumferential array of rigid stays 36 is preferably provided, each stay 36 spanning between the housing 2 and the at least first cone 34. Referring to FIG. 4, in addition to their support of cone 34, stays 36 advantageously form a circumferential array of gas passage ports 37 which allow communication of gas within the web 24 from the breachward arm 26 to the muzzleward arm 28.

To further form and define the breachward arm 26 of the first "U" channel 22, a second muzzlewardly facing conical wall 38 is preferably provided, such wall 38 constituting a muzzleward or interior face of a second cone 40. Similarly with the first cone 34, the second cone 40 has a vertex positioned at axis 10 within the bullet passage conduit 4. In contrast with the radially outer lip of the first cone 34 which attaches to housing 2 by means of the circumferential array of stays 36, the radially outer end 41 of the second cone 40 is preferably formed wholly with the housing 2 for prevention of any through passage of compressed gases which impinge against the second cone's breachward face 54.

The muzzleward arm 28 of the first "U" channel 22 is preferably bounded by a second breachwardly facing conical wall 42, such wall constituting a breachward face of a third cone 44. In the preferred embodiment, the third cone 44 is configured and mounted within the housing 2 substantially identically with the second cone 40.

In operation of the first circumferentially extending "U" channel 22, referring in particular to FIG. 3, a bullet passing through the conduit 4 at high velocity may approach the section of the conduit 4 which radially inwardly underlies the annular gas outlet port 18. Upon the bullet's approach of port 18, a body of or wave of compressed gas which is driven immediately muzzlewardly from the bullet also approaches port 18. Upon reaching port 18, a significant portion of such muzzleward body of compressed gas immediately expands radially outwardly, and such gas commences to travel radially outwardly and muzzlewardly along the breachward arm 26 of "U" channel 22. Such gas is proximally directed in relation to arm 26 and the direction of flow is indicated by the arrow drawn upon arm 26.

Referring simultaneously to Drawing FIGS. 3 and 4, the fluid flow which is driven by the above described muzzleward body of compressed gas channels through the circumferential array of gas passage ports 37 to be guided by the arcuately curved web 24 along a return passage guided by the muzzleward arm 28. During the transit of such compressed gas out of port 18 along breachward arm 26, along web 24 and thence along muzzleward arm 28, the nose of the bullet which drives the body of gas typically passes channel section 4*b* to at least enter the immediately muzzleward channel section 4*m*. The configuration, placement, and angling of the "U" channel 22 advantageously assures that compressed gas traveling therealong does not impinge against the forward face or nose of the traveling bullet.

Similarly with an unmodified gun barrel muzzle's capacity for harmlessly emitting the muzzleward body of compressed gas away from (i.e., muzzlewardly from) a traveling bullet, the instant inventive sound suppressor harmlessly emits the such body of compressed gas away from, albeit breachwardly from, the traveling bullet. Thus, the instant invention advantageously preserves the ability of an unmodified gun barrel to correctly and harmlessly emit the muzzleward body of compressed gas while effectively reducing the magnitude of a sonic report generated by the breachward body of compressed gas.

In the preferred embodiment of the instant inventive gun barrel sound suppressor, second and third circumferentially extending "U" channels 46 and 56 are preferably formed and supported within the housing 2, the second "U" channel having a curved web 48 and breachward and muzzleward arms 50 and 52, and the third "U" channel 56 similarly having a curved web 58 and breachward and muzzleward arms 62 and 60. In such configuration, the breachward conical wall or breachward face 54 of the second cone 40 bounds the muzzleward arm 52 of the second "U" channel 46. Similarly, the muzzleward face or conical wall 64 of the third cone 44 bounds the breachward arm 62 of "U" channel 56.

As indicated in FIG. 2, a plurality of fourth circumferentially extending "U" channels 66 are also preferably provided, such channels 66 functioning similarly with and being configured similarly with "U" channel 22.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A gun barrel sound suppressor comprising:

(a) a housing having a breach end, having a muzzle end, and having a barrel axis extending between said ends;

(b) a bullet passage conduit aligned with the barrel axis;

(c) an annular gas outlet port, said port opening the bullet passage conduit;

(d) an annular gas inlet port positioned muzzlewardly from the annular gas outlet port, said port further opening the bullet passage conduit;

(e) a circumferentially extending "U" channel having a web, having a breachward arm, and having a muzzleward arm, wherein a distal end of the breachward arm communicates with the annular gas outlet port, and wherein a distal end of the muzzleward arm communicates with the annular gas inlet port.

2. The gun barrel sound suppressor of claim 1 wherein the web is arcuately curved.

3. The gun barrel sound suppressor of claim 2 wherein the annular gas outlet port is larger than the annular gas inlet port.

4. The gun barrel sound suppressor of claim 2 wherein the breachward and muzzleward arms are canted breachwardly from the web.

5. The gun barrel sound suppressor of claim 4 wherein the breachward and muzzleward arms are respectively bounded by a breachwardly facing conical wall and a muzzlewardly facing conical wall, and further comprising a cone having breachward and muzzleward faces, said faces respectively comprising said conical walls.

6. The gun barrel sound suppressor of claim 5 further comprising a plurality of stays spanning between the housing and the cone.

7. The gun barrel sound suppressor of claim 6 wherein the stays are circumferentially arrayed.

8. The gun barrel sound suppressor of claim 7 further comprising a circumferential array of gas passage ports, each such port being circumferentially bounded by a pair of the stays.

9. The gun barrel sound suppressor of claim 5 further comprising a second cone having a muzzleward face, said face bounding the breachward arm.

10. The gun barrel sound suppressor of claim 9 further comprising a third cone having a breachward face, said face bounding the muzzleward arm.

11. The gun barrel sound suppressor of claim 10 wherein the second cone has a breachward face, and further comprising a second circumferentially extending "U" channel having a muzzleward arm, the second cone's breachward face bounding said muzzleward arm.

12. The gun barrel sound suppressor of claim 11 wherein the third cone has a muzzleward face, and further comprising a third circumferentially extending "U" channel having a breachward arm, the third cone's muzzleward face bounding said breachward arm.

13. The gun barrel sound suppressor of claim 12 wherein the third cone nests with the first cone, and wherein the first cone nests within the second cone.

14. The gun barrel sound suppressor of claim 13 wherein the first, second, and third cones have vertices, and wherein each of said cones' vertices is positioned at the bullet passage conduit.

15. The gun barrel sound suppressor of claim 14 further comprising a plurality of fourth circumferentially extending "U" channels, each such channel communicating with the bullet passage conduit.

* * * * *